US005840175A

United States Patent [19]

Aldous et al.

[11] Patent Number: 5,840,175

[45] Date of Patent: Nov. 24, 1998

[54] PROCESS OILS AND MANUFACTURING PROCESS FOR SUCH USING AROMATIC ENRICHMENT WITH EXTRACTION FOLLOWED BY SINGLE STAGE HYDROFINISHING

[75] Inventors: Keith K. Aldous, Legue City; Jacob Ben Angelo, Spring, both of Tex.; Joseph Philip Boyle, Baton Rouge, La.

[73] Assignee: Exxon Research and Engineering Company, Florham Park, N.J.

[21] Appl. No.: 920,554

[22] Filed: Aug. 29, 1997

[51] Int. Cl.[6] ..... C10G 23/00

[52] U.S. Cl. ..... 208/87; 208/264; 208/210; 208/311; 208/87; 208/301; 208/302; 208/45; 208/89; 208/211

[58] Field of Search ..... 208/14, 19, 211, 208/264, 87, 89, 302, 301

[56] References Cited

U.S. PATENT DOCUMENTS

| | | | |
|---|---|---|---|
| 3,627,673 | 12/1971 | Sproule | 208/19 |
| 3,732,154 | 5/1973 | Mills et al. | 208/87 |
| 3,839,189 | 10/1974 | Mills et al. | 208/14 |
| 3,904,507 | 9/1975 | Mills | 208/14 |
| 3,925,220 | 12/1975 | Mills | 208/14 |
| 4,401,560 | 8/1983 | Geistert | 208/14 |
| 4,521,296 | 6/1985 | Kunihiro | 208/14 |
| 4,801,373 | 1/1989 | Corman | 208/14 |

*Primary Examiner*—Helane Myers
*Attorney, Agent, or Firm*—Roy J. Ott; James H. Takemoto

[57] ABSTRACT

A method for producing a process oil is provided in which an aromatic extract oil is added to a naphthenic rich feed to provide a blended feed. The blended feed is then extracted with an aromatic extract solvent to yield a raffinate which subsequently is hydrotreated to provide a process oil.

9 Claims, No Drawings

PROCESS OILS AND MANUFACTURING PROCESS FOR SUCH USING AROMATIC ENRICHMENT WITH EXTRACTION FOLLOWED BY SINGLE STAGE HYDROFINISHING

FIELD OF THE INVENTION

The present invention is concerned generally with the production of process oils from naphthenic containing distillates.

BACKGROUND OF THE INVENTION

The properties of naphthenic rich feeds make them particularly useful in a broad range of naphthenic oils used in a wide variety of industrial applications. For example, the naphthenic oils are used in rubber processing for reasons such as reducing the mixing temperature during the processing of the rubber, and preventing scorching or burning of the rubber polymer when it is being ground down to a powder, or modifying the physical properties of the finished rubber. These oils are finished by a refining procedure which imparts to the oils their excellent stability, low staining characteristics and consistent quality.

End-users of such process oils desire oils with increased solvency as indicated by a lower aniline point. Accordingly, one object of the present invention is to provide a process oil that has a lower a aniline point and consequently increased solvency.

Additionally, the availability of conventional naphthenic crudes is declining while the demand for higher solvency process oils is increasing. Accordingly, it is another object of the present invention to provide process oils with increased solvency using lesser amounts of naphthenic-rich feeds such as naphthenic distillate.

SUMMARY OF THE INVENTION

A method for producing a process oil is provided which comprises:

adding an aromatic containing extract oil to a naphthenic rich feed to provide a blended feed for processing;

extracting the blended feed with an aromatic extraction solvent at temperatures in the range of about 20° C. to about 100° C. and at solvent to feed ratios in the range of about 0.5:1 to about 3:1 by volume to obtain a raffinate for hydrofinishing;

and then hydrotreating the raffinate in a hydrotreating stage maintained at a temperature of about 275° C. to about 375° C., a hydrogen partial pressure of 300 to 2500 psia, and at a space velocity of 0.1 to 2 v/v/hr to provide a process oil.

These and other embodiments of the present invention will become apparent after a reading of detailed description which follows.

DETAILED DESCRIPTION OF THE INVENTION

Typically, the naphthenic rich feed used to produce process oils in accordance with the method of the present invention will comprise a naphthenic distillate, although other naphthenic rich materials obtained by extraction or solvent dewaxing may be utilized.

In accordance with the present invention an aromatic extract oil is added to the naphthenic rich distillate to provide a blended feed for processing. Preferably the aromatic extract oil used in the present invention will have an aniline point of less than about 40° C. for lower viscosity oils (e.g. from about 70 to 1000 SSU @ 100° ) and less than about 70° C. for the higher viscosity oils (e.g. greater than about 1000 SSU @ 100° ).

Such an aromatic oil suitable in the process of the present invention is readily obtained by extracting a naphthenic rich feed such as a naphthenic distillate with aromatic extraction solvents at temperatures in the range of about 20° C. to about 100° C. in extraction units known in the art. Typical aromatic extraction solvents include N-methylpyrrolidone, phenol, N-N-dimethylformamide, dimethylsulfoxide, methylcarbonate, morpholine, furfural, and the like and preferably N-methylpyrrolidone or phenol. Solvent oil treat ratios are generally about 0.5:1 to about 3:1. The extraction solvent preferably contains water in the range of about 1 vol. % to about 10 vol. %. Basically the extraction can be conducted in a counter current type extraction unit. The resultant aromatic rich solvent extract stream is then solvent stripped to provide an aromatic extract oil having an aromatic content of about 50% to 90% by weight.

The aromatic extract oil is mixed with the naphthenic rich feed from which it is extracted in the extract to feed volume ratio in the range of about 10:90 to about 90:10, preferably 25:75 to 50:50. Typical but not limiting examples of distillates, extract oils, and distillate/extract mixtures are given in Table 1 for lower viscosity oils and Table 2 for higher viscosity oils.

TABLE 1

LOW VISCOSITY DISTILLATE, EXTRACT OIL, AND BLENDS

| | Distillate Feed | Extract Oil | Extract/Distillate (25:75) | Extract/Distillate (50:50) |
|---|---|---|---|---|
| Physical Properties | | | | |
| API Gravity, 60/60° F. | 24.5 | 15.8 | 21.8 | 19.8 |
| Specific Gravity, 60/60° F. | 0.9068 | 0.9606 | 0.9228 | 0.9352 |
| Viscosity Index | 18.5 | −67.9 | −0.1 | −13.7 |
| Viscosity @ 100° F., SSU | 88.9 | 129.2 | 97.5 | 103.3 |
| Refractive Index @ 20° C. | 1.5009 | 1.5364 | 1.5114 | 1.5191 |
| Aniline Point, °F. (°C.) | 156(69) | 76.3(24) | 129(54) | 123(51) |
| Pour Point, °F. | −49 | — | −54 | −54 |
| Flash, °F. | 360 | — | 366 | 356 |
| Sulfur, wt. % | 0.91 | 1.8 | 1.15 | 1.38 |
| Basic Nitrogen, PPM | 123 | 306 | 178 | 217 |
| Total Nitrogen, PPM | 706 | 1529 | 1046 | 1176 |
| Neut Number, KOH/g | 0.78 | 1.91 | 1.09 | 1.34 |

TABLE 1-continued

| LOW VISCOSITY DISTILLATE, EXTRACT OIL, AND BLENDS | Distillate Feed | Extract Oil | Extract/Distillate (25:75) | Extract/Distillate (50:50) |
|---|---|---|---|---|
| Compositional Properties | | | | |
| Clay Gel Saturates, wt. % | 58.3 | 27.2 | 45.1 | 38.5 |
| Clay Gel Aromatics, wt. % | 40.2 | 69.1 | 52.0 | 57.8 |
| Clay Gel Polars, wt. % | 1.6 | 3.7 | 2.9 | 3.7 |
| UV DMSO, 280–289 nm, Absorbance/cm | 1196 | — | 1390 | 1620 |
| UV DMSO, 290–299 nm Absorbance/cm | 1060 | — | 1220 | 1410 |
| UV DMSO, 300–359 nm, Absorbance/cm | 823 | — | 930 | 1040 |
| UV DMSO, 360–400 nm, Absorbance/cm | 43 | — | 40 | 50 |

TABLE 2

| HIGH VISCOSITY DISTILLATE, EXTRACT OIL, AND BLENDS | Distillate Feed | Extract Oil | Extract/Distillate (25:75) | Extract/Distillate (50:50) |
|---|---|---|---|---|
| Physical Properties | | | | |
| API Gravity, 60/60° F. | 19.8 | 17.4 | 18.9 | 18.5 |
| Specific Gravity, 60/60° F. | 0.9350 | 0.9504 | 0.9406 | 0.9436 |
| Viscosity Index | 34.8 | −34.6 | 20 | 6.6 |
| Viscosity, SSU @ 100° F. | 2873 | 1382 | 2375 | 1969 |
| Refractive Index @ 20° C. | 1.5191 | 1.5285 | 1.5210 | 1.5228 |
| Aniline Point, °F. (°C.) | 197(92) | 154(68) | 174(79) | 176(80) |
| Pour Point, °F. | 21 | — | — | — |
| Flash, °F. | 540 | — | 503 | 474 |
| Sulfur, wt. % | 1.21 | 0.43 | 0.98 | 0.83 |
| Basic Nitrogen, PPM | 486 | 368 | 460 | 453 |
| Total Nitrogen, PPM | 2474 | 2352 | 4347 | 2897 |
| Neut Number, KOH/g | 0.93 | 0.02 | 0.57 | 0.37 |
| Compositional Properties | | | | |
| Clay Gel Saturates, wt. % | 47.9 | 39.8 | 45.6 | 43.2 |
| Clay Gel Aromatics, wt. % | 44.6 | 56.9 | 47.5 | 50.9 |
| Clay Gel Polars, wt. % | 7.5 | 3.3 | 6.9 | 5.9 |
| UV DMSO, 280–289 nm, Absorbance/cm | 2613 | | 3930 | 2500 |
| UV DMSO, 290–299 nm, Absorbance/cm | 2356 | | 3480 | 2170 |
| UV DMSO, 300–359 nm, Absorbance/cm | 1960 | | 2920 | 1740 |
| UV DMSO, 360–400 nm, Absorbance/cm | 333 | | 710 | 280 |

The resultant blended feed is then subjected to a solvent extraction using aromatic extraction solvents such as those previously described in connection with obtaining the aromatic extract oil for blending but under generally milder conditions. Thus, for example in extracting the blended feed the ratio of solvent to blended feed is generally in the range of about 0.5:1 to about 3:1 and the extraction is conducted at a temperature in the range of about 20° C. to about 100° C. and the extraction solvent contains water in the range of about 1 vol % to about 50 vol %; and preferably greater than about 5 vol %. The resultant raffinate is then subjected to a hydrotreating step in a single hydrotreating stage which is maintained at a temperature in the range of about 275° C. to 375° C. and preferably in the range of 340° C. to 365° C. at a hydrogen partial pressure of 300 to 2500 psia and preferably 500 to 1200 psia and at a space velocity of about 0.1 to 2 v/v/hr.

The hydrotreating is effected conventionally under hydrogen pressure and with a conventional catalyst. Catalytic metals such as nickel, cobalt, tungsten, iron, molybdenum, manganese, platinum, palladium, and combinations of these supported on conventional supports such as alumina, silica, magnesia, and combinations of these with or without acid-acting substances such as halogens and phosphorous may be employed. A particularly preferred catalyst is a nickel molybdenum phosphorus catalyst supported on alumina, for example KF-840.

As is shown in the following examples, the present invention has been found to produce a process oil having a substantially reduced aniline point and hence increased solvency. Moreover the data shows the product of the present invention requires less distillate than is required to produce an equivalent amount of product if the procedure in the comparative example is followed.

COMPARATIVE EXAMPLE 1

(Base Case 1)

In this comparative example, a naphthenic feedstock having a viscosity of 89 SSU at 100° F. was passed through two hydrotreating stages under the conditions outlined in Table 3 below. The product from stage 1 was stripped in an intermediate step to remove hydrogen sulfide and ammonia and the resultant material treated in stage 2. The product of this comparative example 1 had the properties shown in Table 6 of examples 1 and 2.

TABLE 3

| Conditions | Stage 1 | Stage 2 |
|---|---|---|
| Temperature, °C. | 355 | 315 |
| $H_2$ Partial Pressure, psia | 550 | 652 |
| $H_2$ Treat, SCF/B | 450 | 450 |
| Space Velocity, V/V/HR | 0.7 | 0.7 |

Examples 1 and 2

In these examples a quantity of the same naphthenic feedstock utilized in comparative example 1 was extracted using 6% water in phenol in a countercurrent extraction column at a treat ratio of 1.2:1 and at a temperature of 58° C. to provide an aromatic extract oil after the removal of the solvent. From the aromatic extract oil two blends were prepared. In example 1, 75% by volume naphthenic distillate was blended with 25% of extract oil and in example 2, 50% by volume by distillate was blended with 50% of the extract oil. (Refer to Table 1.) The blends were first extracted using phenol under conditions set forth in Table 4 below.

TABLE 4

| Conditions | 25% Extract Example 1 | 50% Extract Example 2 |
|---|---|---|
| Temperature, °C. | 72 | 72 |
| Water in Phenol, % | 25 | 30 |
| Treat, Ratio | 1.3:1 | 1.85:1 |
| Raffinate Yield, LV % | 90 | 90 |

After the solution removal, the raffinates produced from the distillate/extract were hydroftnished using a single stage under the conditions set forth in Table 5.

TABLE 5

| Condition | Examples 1 and 2 |
|---|---|
| Temperature, °C. | 315 |
| $H_2$, Partial Pressure, psia | 656 |
| $H_2$ Treat, SCF/Barrel | 500 |
| Space Velocity, V/V/HR | 0.7 |

The product of the hydrofinishing step represents an improvement which requires 25% to 50% less distillate than is required to produce an amount of product equivalent to the comparative example. The quality of the product is set forth in Table 6 which follows. The products produced from both low viscosity blends have increased solvency as shown by their lower aniline points.

TABLE 6

| Properties | Comparative Example 1 | 25% Extract Example 1 | 50% Extract Example 2 |
|---|---|---|---|
| Specific Gravity, 60/60 °F. | 0.8925 | 0.8989 | 0.9112 |
| Aniline Point, °F. | 171 | 161 | 146 |
| Sulfur, wt. % | <0.05 | 0.2 | 0.31 |
| Viscosity, 100° F., SSU | 84.2 | 85.6 | 90.8 |
| HPLC-2, wt. % | | | |
| Saturates | 67.4 | 63.8 | 53.6 |
| 1–ring aromatics | 28.2 | 26.9 | 31.8 |
| 2–ring aromatics | 4.3 | 7.1 | 11.6 |
| 3+ring aromatics | 0 | 0 | 2.2 |
| PNA's 4–6, ppm | 12.8 | 16.4 | 21.5 |
| Mutagenicity Index | 0 (Pass) | 2 (Pass) | 4 (Fail) |
| IP 346, wt. % | 4 | 4.2 | 6.2 |
| UV-DMSO Absorbance, $cm^{-1}$ | | | |
| 280–289 nm | 386 | 298 | 495 |
| 290–299 nm | 296 | 245 | 427 |
| 300–359 nm | 218 | 162 | 297 |
| 360–400 nm | 10 | 1 | 3 |

Comparative Example 2

(Base Case 2)

In this comparative example, a naphthenic distillate having a viscosity of 2873 SSU at 100° F. and other properties provided in Table 2 hydrofined in two stages using the conditions set forth in Table 7 below.

TABLE 7

| Conditions | Stage 1 | Stage 2 |
|---|---|---|
| Temperature, °C. | 355 | 315 |
| $H_2$ Partial Pressure, psia | 656 | 656 |
| Total Gas Treat (80% $H_2$) Treat, SCF/B | 625 | 625 |
| Space Velocity, V/V/HR | 0.75 | 0.75 |

The product of the second stage has the properties shown in Table 10.

Examples 3 and 4

Following the general procedure outlined in examples 1 and 2, two blends were prepared using a 25% and 50% extract obtained from a corresponding intermediate distillate with viscosity of 1382 SSU @ 100° F. distillate of comparative example 2. The blends were then extracted under the conditions set forth in Table 7 which follows.

TABLE 8

| Conditions | 25% Extract Example 3 | 50% Extract Example 4 |
|---|---|---|
| Temperature, °C. | 83 | 74 |
| Water in Phenol, % | 20 | 20 |
| Treat, Ratio | 2.1:1 | 1.67:1 |
| Raffinate Yield, LV % | 91 | 91 |

The raffinate produced from the above extracted blends were hydrofinished using a single stage under the conditions set forth in Table 9 which follows.

TABLE 9

| Condition | Examples 3 and 4 |
|---|---|
| Temperature, °C. | 315 |
| $H_2$, Partial Pressure, psia | 640 |
| $H_2$ Treat, SCF/B | 500 |
| Space Velocity, V/V/HR | 0.75 |

The products of the hydrofinishing steps represent an improvement in that it requires 25% to 50% less distillate to produce an amount of product equivalent to the base case. The quality of the product is set forth and compared with that comparative example 2 in Table 9 which follows.

TABLE 10

| Properties | Comparative Example 2 | 25% Extract Example 3 | 50% Extract Example 4 |
|---|---|---|---|
| Specific Gravity, 60/60 °F. | 0.9161 | 0.9222 | 0.9279 |
| Aniline Point, °F. | 207 | 203 | 191 |
| Sulfur, wt. % | 0.2 | 0.3 | 0.3 |
| Viscosity, 100° F., SSU | 1171 | 1425 | 1277 |
| PNA's 4–6 Ring, ppm | 13.5 (typical) | 12.4 | 14.9 |
| Mutagenicity Index | N/A | <1 (Pass) | <1 (Pass) |
| IP 346, wt. % | N/A | 3.3 | 3.1 |
| UV-DMSO Absorbance, $cm^{-1}$ | | | |
| 280–289 nm | 821 | 287 | 317 |
| 290–299 nm | 783 | 261 | 288 |
| 300–359 nm | 678 | 221 | 241 |
| 360–400 nm | 86 | 26 | 28 |

What is claimed is:

1. A method for producing a process oil comprising:

adding an aromatic extract oil to a naphthenic rich feed to provide a blended feed;

extracting the blended feed with an aromatic extraction solvent at a temperature of from about 20° C. to about 100° C. and a solvent to feed ratio of 0.5:1 to 3:1 to obtain a raffinate for hydrotreating;

hydrotreating the raffinate at a temperature of about 275° C. to about 375° C. and a hydrogen partial pressure of 300 to 2500 psia at a space velocity of about 0.1 to 1 v/v/hr.

2. The method of claim 1 wherein the aromatic extraction solvent contains from about 1 vol % to about 50 vol % water.

3. The method of claim 1 wherein the naphthenic rich feed is a naphthenic distillate.

4. The method of claim 3 wherein aromatic extract oil is added to the naphthenic distillate in the volume ratio of about 10:90 to about 90:10.

5. The method of claim 4 wherein the volume ratio of aromatic extract oil to naphthenic distillate is the range of 25:75 to 50:50.

6. The method of claim 5 wherein the extraction solvent contains greater than 5 vol % water.

7. A method for producing a process oil comprising:

(a) extracting a naphthenic rich feed with an aromatic extraction solvent at a temperature of about 20° C. to about 100° C., and a solvent to feed ratio of 0.5:1 to 3:1, the solvent containing from about 1 vol % to about 20 vol % water to obtain a solution;

(b) removing the solvent from the solution to obtain an aromatic extract oil;

(c) adding the aromatic extract oil to a naphthenic rich feed to obtain a blended feed;

(d) extracting the blended feed with an aromatic extraction solvent under milder conditions than the extraction of step (a) to obtain a raffinate;

(e) hydrotreating the raffinate at a temperature of about 275° C. to about 375° C., a hydrogen partial pressure of 300 to 2500 psia at a space velocity of about 0.1 to about 2 v/v/hr.

8. The method of claim 7 wherein the solvent of step (d) contains greater than about 10 vol % water.

9. The method of claim 8 wherein the aromatic extract oil to feed in the blended feed is in the range of 25:75 to 50:50.

* * * * *